US006795050B1

(12) United States Patent
Ino et al.

(10) Patent No.: US 6,795,050 B1
(45) Date of Patent: Sep. 21, 2004

(54) LIQUID CRYSTAL DISPLAY DEVICE

(75) Inventors: Masumitsu Ino, Kanagawa (JP); Toshikazu Maekawa, Kanagawa (JP); Yoshiharu Nakajima, Kanagawa (JP); Hiroaki Ichikawa, Kanagawa (JP)

(73) Assignee: Sony Corporation (JP)

( * ) Notice: Subject to any disclaimer, the term of this patent is extended or adjusted under 35 U.S.C. 154(b) by 458 days.

(21) Appl. No.: 09/383,923

(22) Filed: Aug. 26, 1999

(30) Foreign Application Priority Data

Aug. 31, 1998 (JP) ..... P10-244773

(51) Int. Cl.[7] ..... G09G 3/36
(52) U.S. Cl. ..... 345/100; 345/94
(58) Field of Search ..... 345/87, 88, 92, 345/94, 95, 96, 98, 99, 100, 103

(56) References Cited

U.S. PATENT DOCUMENTS 5,034,735 A * 7/1991 Inoue et al. ..... 340/784
5,166,671 A * 11/1992 Maekawa ..... 345/100
5,448,384 A * 9/1995 Uchino et al. ..... 359/59
5,523,772 A * 6/1996 Lee ..... 345/100
5,654,735 A * 8/1997 Nakajima ..... 345/99
5,784,042 A * 7/1998 Ono et al. ..... 345/208
5,818,403 A * 10/1998 Nakamura et al. ..... 345/74
5,936,617 A * 8/1999 Uchino et al. ..... 345/204
6,157,358 A * 12/2000 Nakajima et al. ..... 345/96
6,335,778 B1 * 1/2002 Kubota et al. ..... 345/98

FOREIGN PATENT DOCUMENTS

EP 0 837 446 A1 4/1998

OTHER PUBLICATIONS

Y. Nishihara et al., *Fully Integrated Poly–Si TFT CMOS Drivers for Self–Scanned Light Valve*, SID Digest, May 1992, pp. 609–612.

* cited by examiner

*Primary Examiner*—Bipin Shalwala
*Assistant Examiner*—Jeff Piziali
(74) *Attorney, Agent, or Firm*—Rader, Fishman & Grauer PLLC; Ronald P. Kananen

(57) ABSTRACT

An active-matrix-type liquid crystal display device supplies signal potentials to signal lines of a liquid crystal display panel according to a time-division drive method using time-division switches. The low-level potential of select pulses to be supplied from a select pulse generating circuit to CMOS analog switches of the time-division switches is set to be lower than the low-level potential of a signal potential output from a horizontal drive circuit. With this arrangement, even if the signal potential of a non-selected signal line is decreased due to the crosstalk of a signal potential from a selected signal line to the non-selected signal line, the generation of insufficient contrast and non-uniformity of the luminance in the horizontal direction can be prevented. As a consequence, a high image quality is maintained.

25 Claims, 10 Drawing Sheets

LIQUID CRYSTAL DISPLAY DEVICE

BACKGROUND OF THE INVENTION

1. Field of the Invention

The present invention relates to liquid crystal display (LCD) devices. More particularly, the invention relates to an active-matrix-type LCD device which supplies signal potentials to signal lines of an LCD panel according to a time-division drive method.

2. Description of the Related Art

Currently, active-matrix-type LCD devices are dominantly used as LCD devices for use in personal computers and word processors. The active-matrix-type LCD devices exhibit excellent response speed and image quality characteristics, and are thus suitable for use in color-type LCD devices which have recently been put into practical use. In this type of device, non-linear devices, such as transistors or diodes, are used for the individual pixels of an LCD panel, and more specifically, thin film transistors (TFTs) are formed on a transparent insulating substrate (for example, a glass substrate).

In LCD devices, and in particular, in large LCD devices, a driver IC, which is a horizontal drive circuit for sequentially supplying signal potentials to lines of pixels, is formed on an external circuit board, which is provided separately from the transparent insulating substrate on which the LCD panel is formed. Generally, outputs of the external driver IC and signal lines of the LCD panel have a one-to-one relationship. That is, a signal potential output from each output terminal of the driver IC is supplied to the corresponding signal line.

In contrast, with a view to achieving the miniaturization of the driver IC, a time-division drive method is known for driving an LCD panel, which allows the number of output pins i.e., (output terminals) of the driver IC to be reduced. In this method, a plurality of signal lines are collected as one unit block, and a signal potential to be supplied to one block of the signal lines is output from the driver IC in time series. Meanwhile, a time-division switch is provided for the LCD panel so as to time-divide the time-series signal potentials output from the driver IC, thereby sequentially supplying the divided signal potentials to the corresponding signal lines.

The following drive methods may be employed in the above-described type of LCD device using the time-division drive method. In one method, the polarity of image data to be supplied to each pixel is inverted in every horizontal scanning (1H) period for a common voltage VCOM, which is referred to as the "1H inversion drive method". In another method, the common voltage VCOM is AC-inverted in every 1H period, which is referred to as the "1H common (VCOM) inversion drive method". If the 1H inversion drive method is used singly or in combination with the 1H common inversion drive method for the above type of liquid crystal device, fluctuations of the writing potential caused by crosstalk of the signal potential from a selected signal line to a non-selected signal line cannot be ignored. The reason for this is discussed below in detail with reference to FIG. 12 illustrating the configuration of the time-division switch.

In FIG. 12, a time-division switch 101 is formed of a CMOS analog switch formed by connecting an NchMOS transistor and a PchMOS transistor in parallel to each other. The time-division switch 101 is connected between a common signal line 102 for transmitting a signal voltage output from a driver IC (not shown) and a signal line 103 of an LCD panel. With this arrangement, by applying a select pulse S and its inverted pulse XS to the gates of the respective NchMOS transistor and PchMOS transistor, the time-division switch 101 transmits a signal voltage from the driver IC to the signal line 103.

As discussed above, due to the crosstalk of the signal potential from a selected signal line to a non-selected signal line, the writing potential is changed. Then, the signal potential of the non-selected signal line becomes lower, as illustrated in FIG. 13, with respect to a ground potential (0 V). Then, the gate potential of the NchMOS transistor becomes positive with respect to the potential of the signal line, i.e., to the source potential of the NchMOS transistor. This potential relationship satisfies the condition of switching on (conducting) the NchMOS transistor. As a result, the NchMOS transistor is activated.

This causes the signal charge to flow out of the non-selected signal line via the NchMOS transistor, thereby lowering the signal potential of the non-selected signal line. As a consequence, a resulting image suffers from insufficient contrast and non-uniformity of the luminance in the horizontal direction, thereby degrading the image quality.

SUMMARY OF THE INVENTION

Accordingly, in view of the above background, it is an object of the present invention to provide an LCD device that maintains a high image quality by eliminating the generation of insufficient contrast and non-uniformity of the luminance in the horizontal direction caused by the crosstalk of a signal potential from a selected signal line to a non-selected signal line.

In order to achieve the above object, according to the present invention, there is provided a liquid crystal display device including a first substrate having a display unit on which pixels are formed at intersections of gate lines for a plurality of rows and signal lines for a plurality of columns, the gate lines and the signal lines being arranged in a matrix. A vertical drive circuit is mounted on the first substrate so as to drive the gate lines. A horizontal drive circuit outputs a time-series signal potential in correspondence with a predetermined number of time-divided portions. A time-division switch time-divides the time-series signal potential output from the horizontal drive circuit and supplies the divided time-series signal potential to a given signal line among the signal lines. A select pulse generating circuit generates a select pulse for activating the time-division switch. A low-level potential of the select pulse is set to be lower than a low-level potential of the signal potential output from the horizontal drive circuit. A second substrate opposes the first substrate with a predetermined gap therebetween. A liquid crystal layer is encapsulated between the first substrate and the second substrate.

According to the above-described liquid crystal display device, if a signal potential is transferred from a selected signal line to a non-selected signal line, the potential of the non-selected signal line is reduced. This further decreases the source potential of an NchMOS transistor of a CMOS transistor, which is used as the time-division switch. In the above arrangement, however, the low-level potential of the select pulses to be applied to the gate of the NchMOS transistor is lower than the low-level potential of the signal potential. Accordingly, the source potential of the NchMOS transistor does not become lower than the gate potential, which would otherwise activate the NchMOS transistor and cause the charge to flow out of the non-selected signal line via the NchMOS transistor. As a consequence, the potential of the non-selected signal line can be maintained at the initially written potential.

DESCRIPTION OF THE PREFERRED EMBODIMENTS

An embodiment of the present invention is described below in detail with reference to the drawings.

Figure 1:
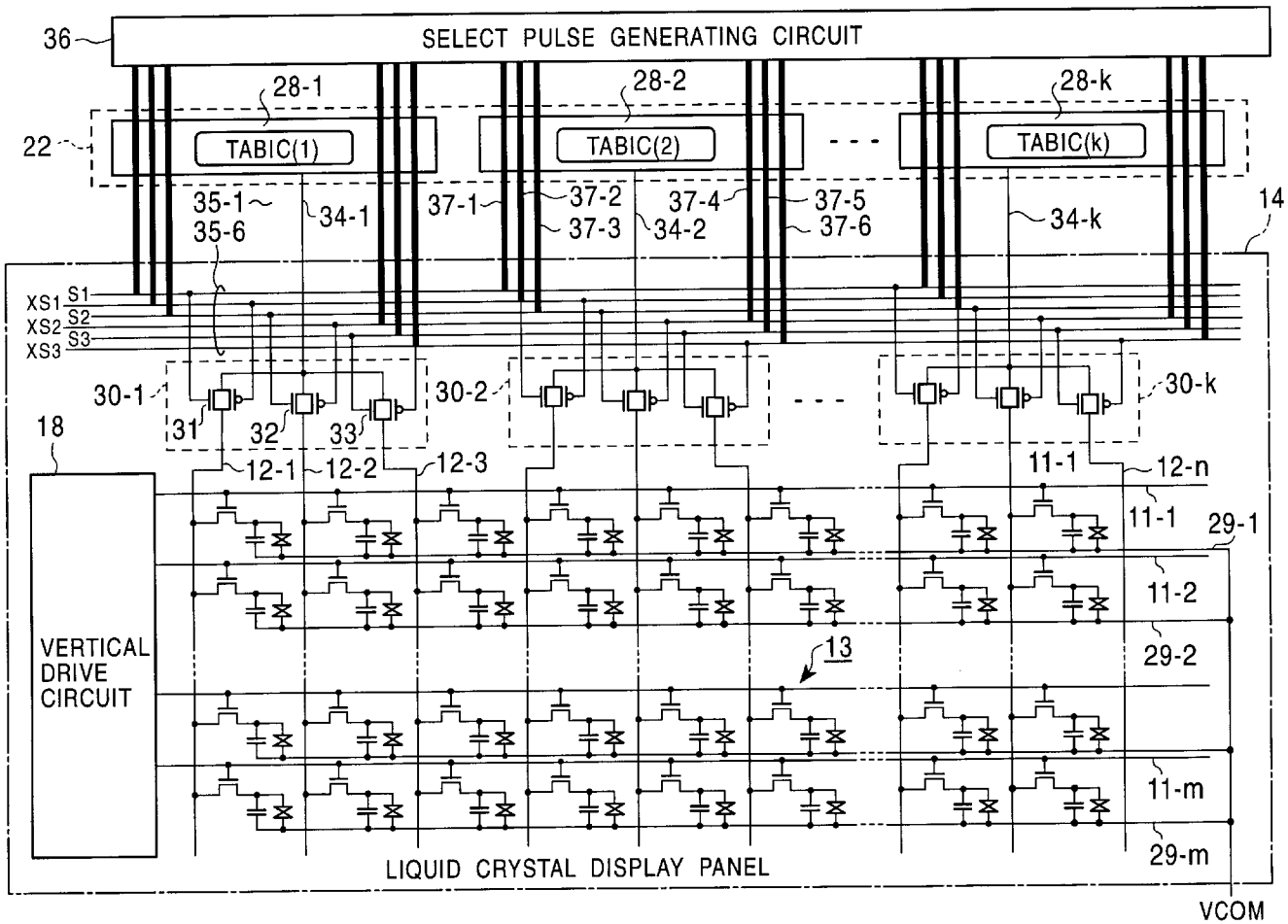
FIG. 1 is a schematic diagram illustrating an active-matrix-type LCD device according to an embodiment of the present invention.

Referring to the block diagram schematically illustrating an active-matrix-type LCD device according to an embodiment of the present invention shown in FIG. 1, an LCD panel (display unit) 14 is formed in the following manner. In FIG. 1, m number of row gate lines 11-1 through 11-m formed of, for example, molybdenum (Mo), and n number of column signal lines 12-1 through 12-n formed of, for example, aluminum (Al), are arranged in a matrix on a transparent insulating substrate, for example, a glass substrate (not shown). At the intersections of the gate lines 11-1 through 11-m and the signal lines 12-1 through 12-n, m×n unit pixels 13 are formed.

Figure 2:
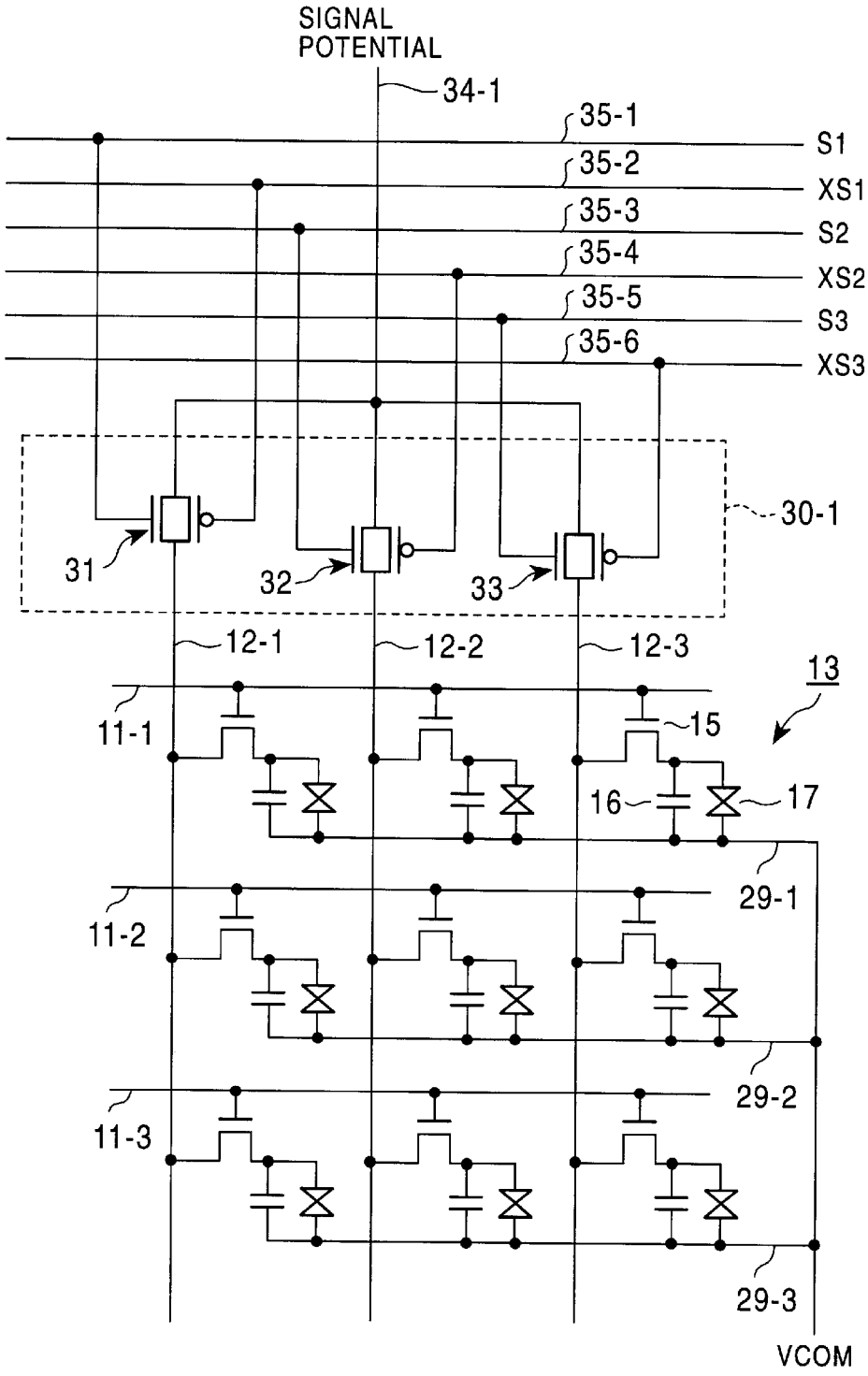
FIG. 2 is an enlarged diagram illustrating the essential portion of the LCD device shown in FIG. 1.

Each unit pixel 13 is formed of, as shown in FIG. 2, a TFT (pixel transistor) 15, made of, for example, polysilicon (Poly-Si) generated by laser recrystallization, a storage capacitor 16, and a liquid crystal capacitor 17. The TFTs 15 are connected at gate electrodes thereof to the gate lines 11-1 through 11-m and at source electrodes thereof to the signal lines 12-1 through 12-n.

In the unit pixel 13 configured as described above, the liquid crystal capacitor 17 generates a capacitance between a pixel electrode made of, for example, indium tin oxide (ITO), connected to the TFT 15, and an opposing electrode made of, for example, ITO, facing the pixel electrode, via a liquid crystal material, such as a twisted nematic (TN) liquid crystal. The potential to be applied to this pixel electrode is written at a high or low level. In this embodiment, as a common voltage VCOM to be applied to all the opposing electrodes via Cs lines 29-1 through 29-m, made of, for example, Mo, a predetermined DC potential is set.

In the unit pixel 13, when the TFT 15 is turned on, the optical transmittance ratio of the liquid crystal is changed, and the storage capacitor 16 is charged. Accordingly, even if the TFT 15 is turned off, the transmittance ratio of the liquid crystal is maintained due to the charging voltage of the storage capacitor 16 until the TFT 15 is subsequently switched on. According to this technique, the quality of a display image on the LCD panel 14 is improved.

Figure 3:
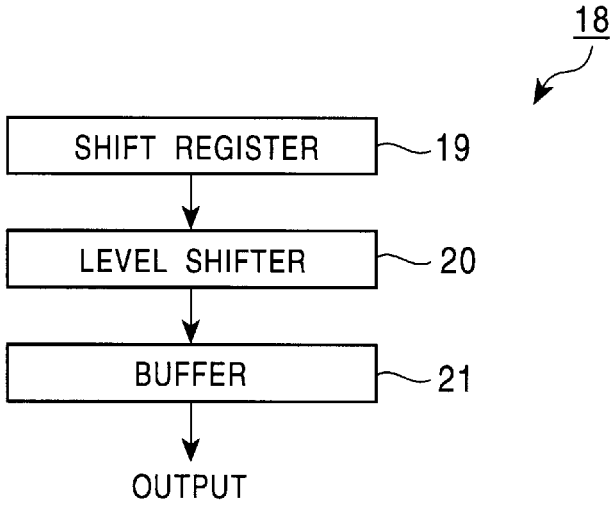
FIG. 3 is a block diagram illustrating-an example of a vertical drive circuit.

Referring back to FIG. 1, a vertical drive circuit 18 made of, for example, a polysilicon TFT, is integrally formed on the same substrate on which the LCD panel 14 is formed. The vertical drive circuit 18 selects the unit pixels 13 line-by-line by sequentially supplying a scanning pulse to the gate lines 11-1 through 11-m, each line being connected at one end to an output terminal of the vertical drive circuit 18, thereby performing vertical scanning. The vertical drive circuit 18 is formed of, as illustrated in FIG. 3, a shift register 19, a level shifter 20, and a buffer 21.

A horizontal drive circuit 22 (FIG. 1), for supplying signal potentials to the signal lines 12-1 through 12-n in accordance with image data is formed as an external circuit on a circuit board different from the substrate on which the LCD panel 14 is formed. This will be discussed in greater detail later. Assuming that digital signals are input into the horizontal drive circuit 22, it is necessary to convert digital signals into analog signals for driving the liquid crystal.

Figure 4:
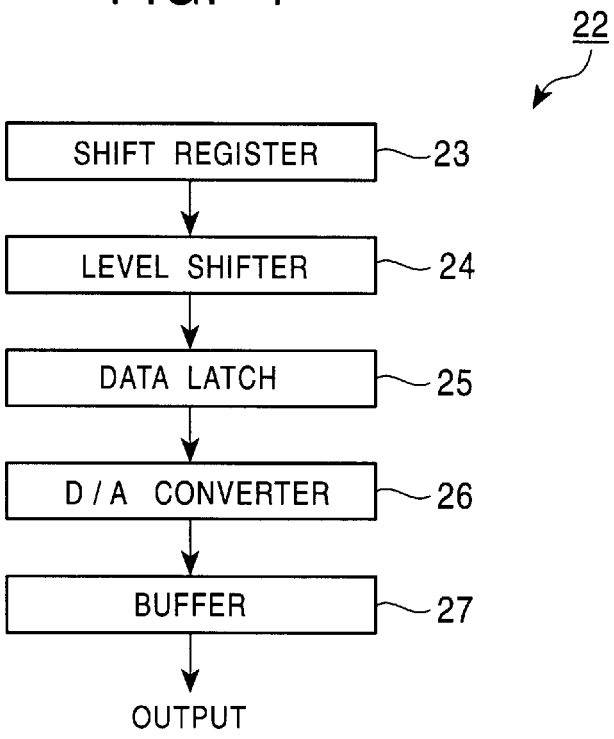
FIG. 4 is a block diagram illustrating an example of a horizontal drive circuit.

To satisfy the above requirement, the horizontal drive circuit 22 is formed of, as illustrated in FIG. 4, a shift register 23, a level shifter 24, a data latch 25, a digital-to-analog (D/A) converter 26, and a buffer 27. Digital image data enabling, for example, at least 8-level 256-color display, is input into the horizontal drive circuit 22.

To implement, for example, three-time-division driving corresponding to red (R), green (G), and blue (B), the n number of column signal lines 12-1 through 12-n are divided by using the number of time-divided portions (in this embodiment, three) as a unit (block). In this case, as shown in FIG. 1, the horizontal drive circuit 22 has k number of tape automated bonding (TAB) driver ICs 28-1 through 28-k (hereinafter referred to as the "TAB IC(1) 28-1 through TAB IC(k) 28-k") corresponding to the number of units k of the signal lines 12-1 through 12-n.

The respective driver IC's TAB IC(1) 28-1 through TAB IC(k) 28-k are mounted on an external circuit board (not shown) different from the substrate on which the LCD panel 14 is formed. The TAB IC(1) 28-1 through TAB IC(k) 28-k sequentially output signal potentials to the plurality of signal lines of the individual units in time series. In this case, to implement the above-described 1H inversion driving, the signal potentials are output by inverting the polarity of the image data in every 1H period for the common voltage VCOM. In response to the above driving method, k number of time-division switches 30-1 through 30-k are provided for the input stages of the signal lines 12-1 through 12-n.

To effect the three-time-division driving, the time-division switch 30-1 is formed of, as shown in FIG. 2, three CMOS analog switches (transmission switches) 31, 32, and 33, each being formed by connecting a PchMOS transistor and an NchMOS transistor in parallel to each other. The time-division switch 30-1 is formed of a TFT made of, for example, polysilicon, and is integrally formed with the LCD panel 14 on the same substrate. The other time-division switches 302 through 30-k are configured similarly to the time-division switch 30-1.

In the time-division switch 30-1, the input terminals of the three analog switches 31, 32, and 33 are connected to each other, and the common node is connected to the output terminal of the TAB IC(1) 28-1 via a common signal line 34-1. With this arrangement, the signal potential having an amplitude of, for example, 0 to 5 V, output from the TAB IC(1) 28-1 in time series is supplied to the input terminals of the three analog switches 31, 32, and 33 via the common signal line 34-1. Each of the output terminals of the analog switches 31, 32, and 33 is connected to one end of each of the three signal lines 12-1, 12-2, and 12-3, respectively.

A time-series signal potential is supplied from the TAB IC(2) 28-2 to the time-division switch 30-2 via a common signal line 34-2 (FIG. 1). Similarly, a time-series signal potential is supplied from the TAB IC(k) 28-k to the time-division switch 30-k via a common signal line 34-k. In this embodiment, for simple representation, only one common signal line is provided for each TAB IC. In practice, however, a plurality of common signal lines are provided for a plurality of output pins of each TAB IC.

On the same substrate on which the LCD panel 14 is formed, two control lines are provided for each analog switch, i.e., a total of six control lines 35-1 through 35-6 are arranged in the direction in which the gate lines 11-1 through 11-m are arranged. With this arrangement, in the time-division switch 30-1, for example, two control input terminals (that is, the gate of the NchMOS transistor and the gate of the PchMOS transistor) of the analog switch 31 are connected to the control lines 35-1 and 35-2, respectively, two control input terminals of the analog switch 32 are connected to the control lines 35-3 and 35-4, respectively, and two control input terminals of the analog switch 33 are connected to the control lines 35-5 and 35-6, respectively, as seen in FIGS. 1 and 2.

A description has been given only of the connecting state of the three analog switches 31 through 33 of the time-division switch 30-1 to the six control lines 35-1 through 35-6. However, the same applies to the other time-division switches 30-2 through 30-k.

Select pulses S1 through S3 and XS1 through XS3 for respectively selecting the three analog switches 31 through 33 of each of the time-division switches 30-1 through 30-k are supplied to the six control lines 35-1 through 35-6 from a select pulse generating circuit 36. The select pulse generating circuit 36 is separately formed on an external circuit board different from the substrate on which the LCD panel 14 is formed. The select pulses XS1 through XS3 are obtained by inverting the select pulses S1 through S3, respectively. In synchronization with the time-series signal potentials output from the TAB IC(1) 28-1 through TAB IC(k) 28-k, the select pulses S1 through S3 and XS1 through XS3 sequentially activate the analog switches 31 through 33 of each of the time-division switches 30-1 through 30-k.

The select pulses S1 through S3 and XS1 through XS3 are input into the LCD panel 14 from the vicinity of the horizontal drive circuit 22, i.e., via a plurality of portions from the upper side of the LCD panel 14. More specifically, six control lines 37-1 through 37-k are respectively laid from the select pulse generating circuit 36 to the six control lines 35-1 through 35-6 located on the LCD panel 14 in correspondence with each of the time-division switches 30-1 through 30-k via an external circuit board (not shown) on which the TAB IC(1) 28-1 through TAB IC(k) 28-k are mounted.

The wiring of the control lines 35-1 through 35-6 is performed by using, for example, TAB low-expansion tape. The control lines 35-1 through 35-6 transmit the select pulses S1, XS1, S2, XS2, S3, and XS3, respectively.

The above-described configuration in which the select pulses S1 through S3 and XS1 through XS3 are input into the LCD panel 14 is an example only, and is not intended to limit the invention.

The low-level signal potential output from the TAB IC(1) 28-1 through TAB IC(k) 28-k is set to be 0 V (ground potential). In contrast, as the select pulses S1 through S3 and XS1 through XS3, the low-level potential output from the select pulse generating circuit 36 is set to be lower than the ground potential, while the high-level potential from the select pulse generating circuit 36 is set to be higher than that (in this embodiment, 5 V) of the signal potential. That is, the select pulse generating circuit 36 generates the pulses having an amplitude of, for example, −2 to 9 V.

Figure 5B:
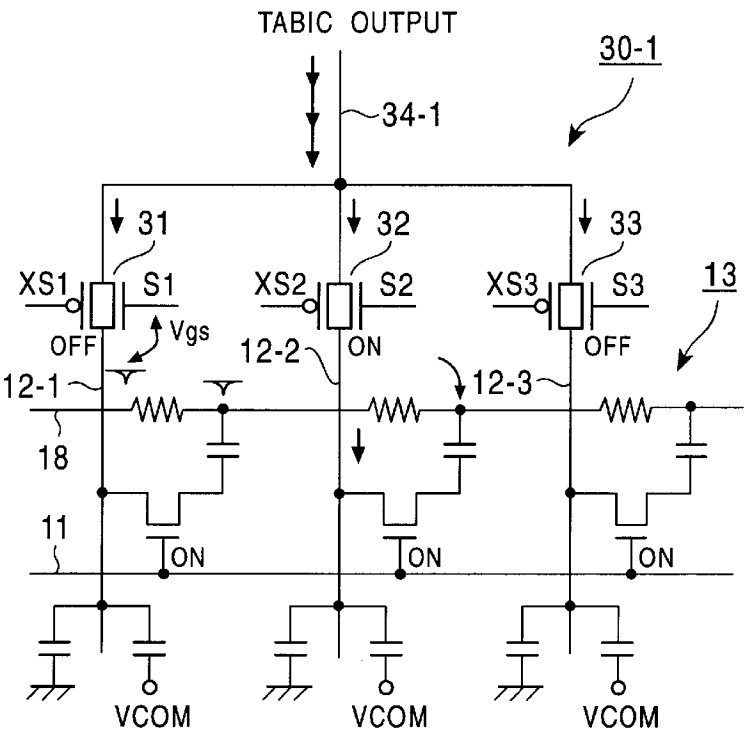
FIGS. 5A and 5B illustrate the crosstalk of a signal potential from a selected signal line to a non-selected signal line.

The reason for setting the low-level potential of the select pulses S1 through S3 and XS1 through XS3 to be lower than the ground potential is given below with reference to FIGS. 5A and 5B by taking the operation of the time-division switch 30-1 by way of example.

Figure 5A:
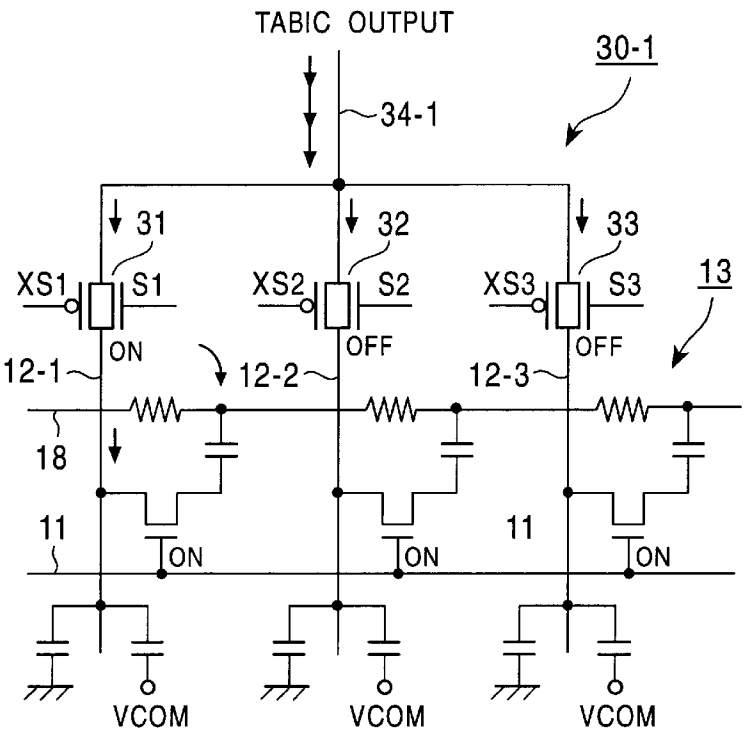

When the select pulse S1 becomes high and the select pulse XS1 becomes low so as to activate (conduct) the analog switch 31, as shown in FIG. 5A, a signal potential supplied from the common signal line 34-1 is written into the signal line 12-1, which is located at the leftmost position among the signal lines 12-1 through 12-3 corresponding to the three-time-division driving. Subsequently, when the select pulse S2 becomes high and the select pulse XS2 becomes low so as to turn on the analog switch 32, as illustrated in FIG. 5B, a signal potential is written into the signal line 12-2, which is located at the middle position.

In this case, the signal line 12-1 is not selected and is almost in the floating state. Then, the signal potential of the signal line 12-2 is transferred to the gate line 11 and the Cs line 29, both of which are horizontally arranged, and is further transferred to the non-selected signal line 12-1 via the gate line 11 and the Cs line 29.

Figure 6A:
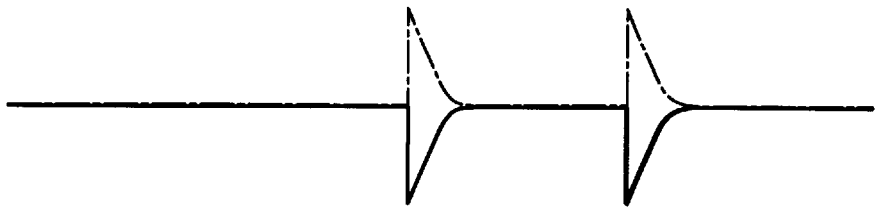
FIGS. 6A and 6B are waveform diagrams illustrating the potential fluctuations of the potential of a Cs line and the signal potential, respectively, when the 1H inversion drive method is employed.
Figure 6B:
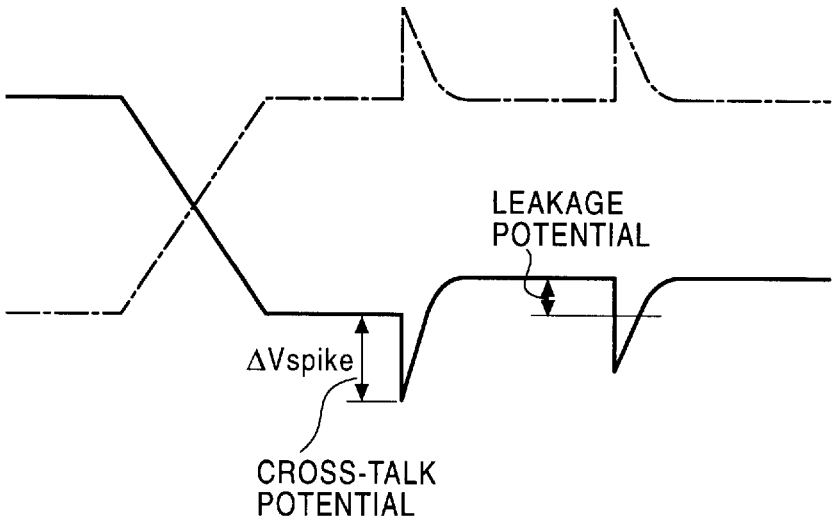

In the 1H inversion driving, the crosstalk caused by the transfer of the signal potential acts upon an increase in the amplitude potential of the Cs line 29 and the non-selected signal line 12-1. The swing of the Cs line 29 and the potential of the non-selected signal line 12-1 caused by the crosstalk are indicated by the waveform diagrams of FIGS. 6A and 6B, respectively. The waveform diagrams reveal that the crosstalk potential ΔVspike transferred onto the Cs line 29 changes the potential of the non-selected signal line 12-1 to be lower than the ground potential (0 V) by about 1.78 V. This is based on simulation results.

This causes the signal line 12-1 of the analog switch 31 to be negative. If the low-level potential of the select pulse S1 is set to be the ground potential, the gate-source voltage Vgs of the NchTFT exceeds the threshold voltage Vth, thereby activating the NchTFT.

Accordingly, the signal charge stored in the signal line 12-1 flows out to the common signal line 34-1 via the activated NchTFT, thereby lowering the signal potential of the signal line 12-1 from the originally written signal potential. This reduces the pixel potential, resulting in degradation of the image quality in a TN liquid crystal used in this embodiment.

Figure 7:
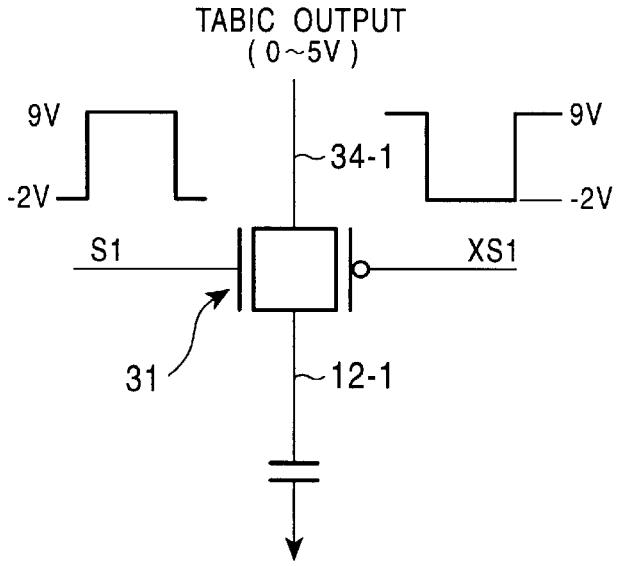
FIG. 7 illustrates the relationship between an analog switch and select pulses according to an embodiment of the present invention.
Figure 8:
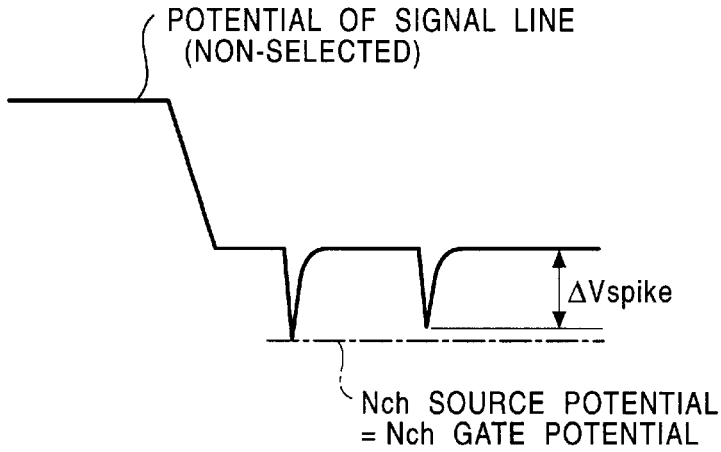
FIG. 8 is a waveform diagram illustrating the signal potential of a signal line according to an embodiment of the present invention.

On the other hand, in this embodiment, the low-level potential of the select pulses S1 through S3 and XS1 through XS3 is set to be, for example, −2 V, as shown in FIG. 7. Accordingly, even if the potential of the non-selected signal line 12-1, i.e., the source potential of the NchTFT, fluctuates, as shown in FIG. 8, to the negative side and becomes lower than the ground potential by about 1.78 V owing to the crosstalk potential ΔVspike transferred onto the Cs line 29, and it does not become lower than the gate potential of the NchTFT, i.e., it is not less than −2 V.

Consequently, the gate-source voltage Vgs of the NchTFT does not exceed the threshold value Vth while being maintained in the negative state, which would otherwise activate the NchTFT and cause the signal charge to flow out of the signal line 12-1 to the common signal line 34-1 via the NchTFT. As a result, the potential of the non-selected signal line 12-1 is maintained at the originally written signal potential.

Figure 9:
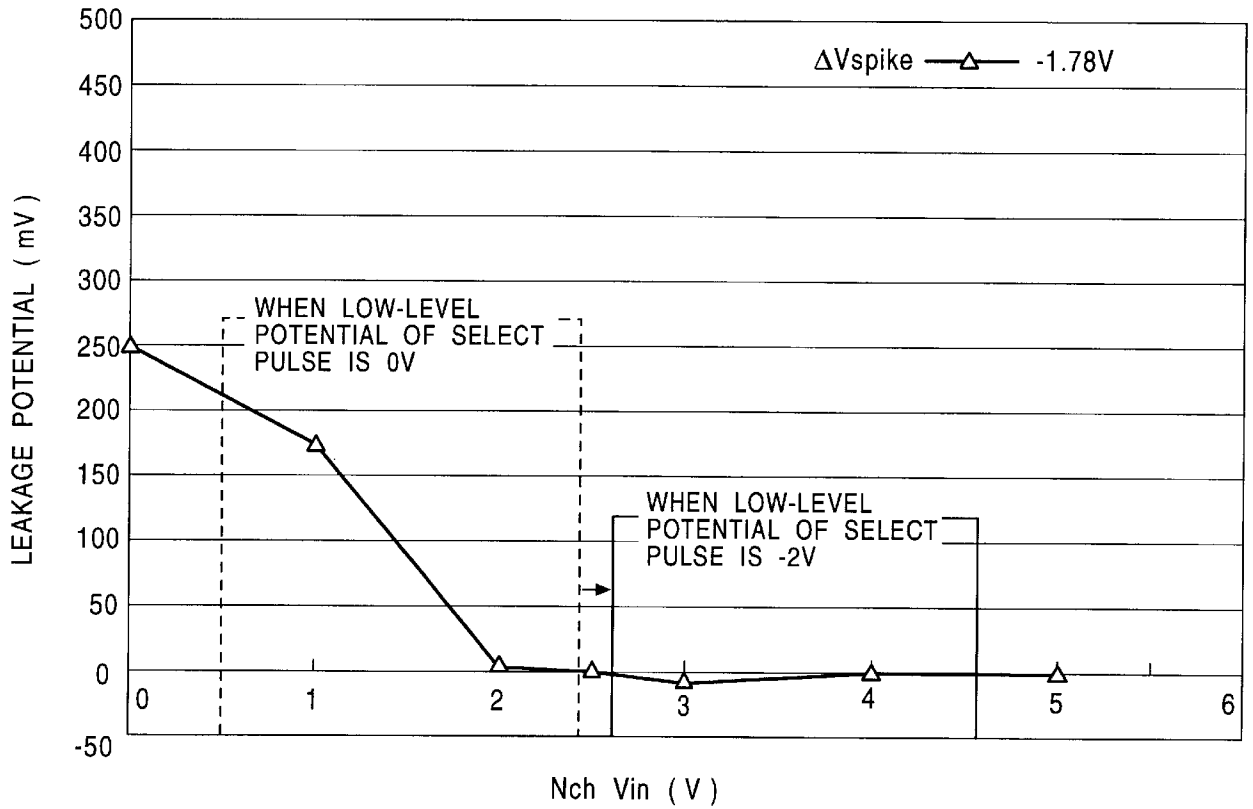
FIG. 9 is a characteristic diagram illustrating the relationship of the threshold voltage Vth of an NchTFT to the leakage potential.

In this manner, the low-level potential of the select pulses S1 through S3 and XS1 through XS3 is set lower than the ground potential. FIG. 9 illustrates the relationship of the leakage voltage (leakage of the signal potential) to the threshold voltage Vth of the NchTFT. FIG. 9 shows that the threshold voltage Vth can be used in a higher voltage range compared to the range of the threshold voltage Vth used when the low-level potential is set to be the ground potential. Even if the threshold voltage Vth of the NchTFT is reduced due to the process, the leakage voltage can be sufficiently suppressed. As a result, the high image quality can be maintained without being influenced by variations in the characteristics of the transistor. As discussed above, if the low-level potential of the select pulses S1 through S3 and XS1 through XS3 is set to be, for example, −2 V, the leakage potential of the signal potential is less than 50 mV, as shown in FIG. 9. Such a small level of leakage potential can be ignored with almost no degradation in the image quality.

In this embodiment, the low-level potential of the select pulses S1 through S3 and XS1 through XS3 is set to be lower than the ground potential, assuming that the low-level potential of the signal potential supplied from the TAB IC(1) 28-1 through TAB IC(k) 28-k is 0 V (ground potential). If it is possible to increase the low-level potential of the signal potential to the positive side, for example, to 2 V, the low-level potential of the select pulses S1 through S3 and XS1 through XS3 can be set to be the ground potential.

Similarly, in this embodiment, the high-level potential of the select pulses S1 through S3 and XS1 through XS3 is set to be, for example, 9 V, assuming that the high-level potential of the signal potential is 5 V. In short, as long as the high-level potential of the select pulses S1 through S3 and XS1 through XS3 is set to be higher than the high-level potential of the signal potential, the leakage potential of the PchTFTs of the analog switches 31, 32, and 33 can be suppressed.

Figure 10A:
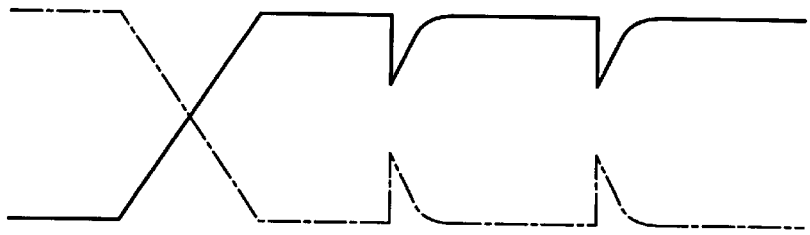
FIGS. 10A and 10B are waveform diagrams illustrating the potential fluctuations of the potential of a Cs line and the signal potential, respectively, when the 1H common (VCOM) inversion drive method is employed.
Figure 10B:
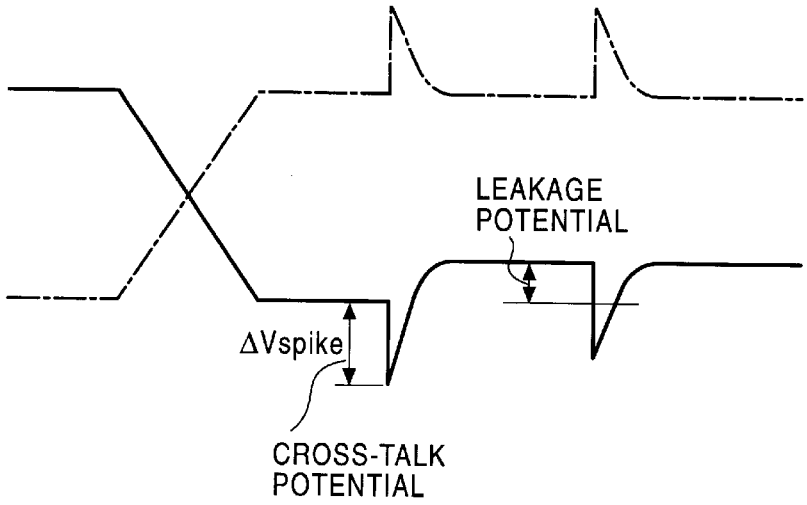

In this embodiment, the 1H inversion drive method is employed in which the polarity of the image data to be supplied to each pixel is inverted in every 1H period for the common voltage VCOM. The above-described technique can also apply to the 1H common (VCOM) inversion drive method in which the common voltage VCOM is AC-inverted in every 1H period. In the case of the 1H common inversion drive method, the potential of the Cs line shown in FIG. 10A and the signal potential of a non-selected signal line shown in FIG. 10B are inverted in every 1H period.

Figure 11:
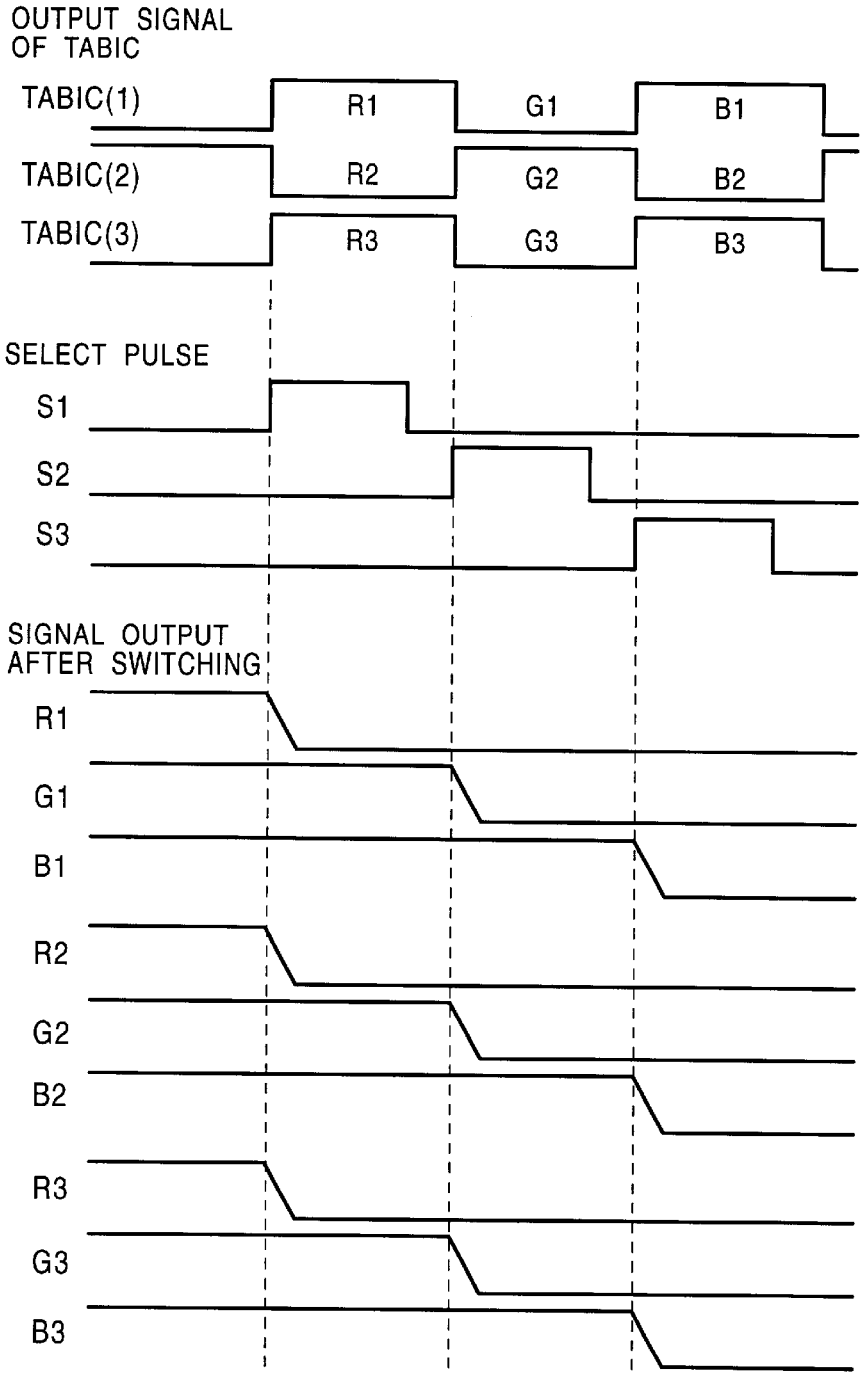
FIG. 11 is a timing chart illustrating the output signals according to three-time-division driving.
Figure 12:
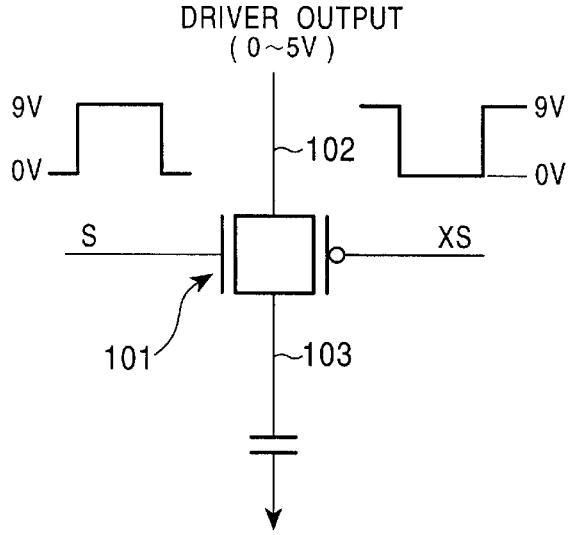
FIG. 12 PRIOR ART
FIG. 12 illustrates the relationship of an analog switch to select pulses according to a conventional LCD device.
Figure 13:
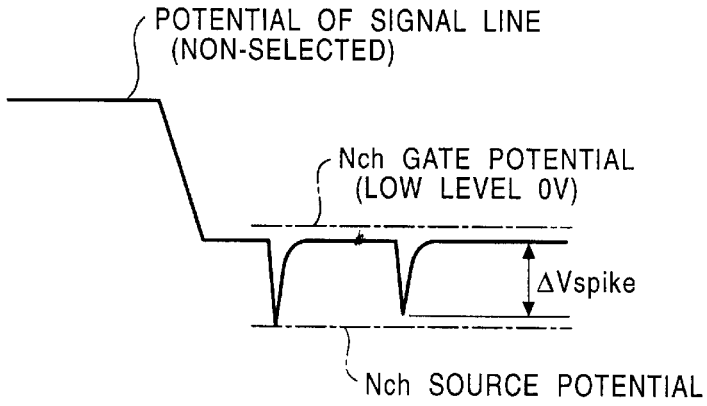
FIG. 13 PRIOR ART
FIG. 13 is a waveform diagram illustrating the signal potential of a signal line according to a conventional LCD device.

A description is now given, with reference to the timing chart of FIG. 11, of the operation of the time-division switches 30-1, 30-2, and 30-3 of the active-matrix-type LCD device constructed in accordance with this embodiment. In FIG. 1, the time-division switch 30-3 and the corresponding TAB IC(3) 28-3 are not shown.

Since the three-time-division driving corresponding to R, G, and B is employed in this embodiment, the signal potentials for the three pixels, i.e., R, G, and B, are sequentially output in time series from the TAB IC(1) 28-1 through the TAB IC(3) 28-3 and are transmitted to the time-division switches 30-1, 30-2, and 30-3 via the common signal lines 34-1, 34-2, and 34-3, respectively.

More specifically, the timing chart of FIG. 11 reveals that the signal potentials of the individual pixels R1, G1, and B1 are transmitted from the TAB IC(1) 28-1 to the time-division switch 30-1, the signal potentials of the individual pixels R2, G2, and B2 are transmitted from the TAB IC(2) 28-2 to the time-division switch 30-2, and the signal potentials of the individual pixels R3, G3, and B3 are transmitted from the TAB IC(3) 28-3 to the time-division switch 30-3. Also supplied to the time-division switches 30-1 through 30-3 are the select pulses S1 through S3 and XS1 through XS3 in synchronization with the above-described time-series signal potentials.

With this arrangement, when the select pulse S1 is at a high level, the analog switch 31 is turned on, thereby supplying the signal potentials of the pixels R1 and R3 to the corresponding signal lines among the signal lines 12-1 through 12-n. When the select pulse S2 is at a high level, the analog switch 32 is activated, thereby supplying the signal potential of the pixel G2 to the corresponding signal line among the signal lines 12-1 through 12-n. When the select pulse S3 is at a high level, the analog switch 33 is turned on, thereby supplying the signal potentials of the pixels B1 and B3 to the corresponding signal lines among the signal lines 12-1 through 12-n.

In this embodiment, the horizontal drive circuit 22 for driving the signal lines 12-1 through 12-n is placed at one side (upper side in this embodiment) of the LCD panel 14. However, the horizontal drive circuit 22 may be divided into two portions with respect to the common voltage VCOM, and the divided portions may be placed at the upper and lower sides of the LCD panel 14.

As is seen from the foregoing description, the present invention offers the following advantages. In the active-matrix-type LCD device which supplies signal potentials to signal lines of an LCD panel according to the time-division drive method, the low-level potential of the select pulses for activating the time-division switches is set to be lower than the low-level potential of the signal potential output from the horizontal drive circuit. Accordingly, even with the occurrence of the crosstalk of a signal potential from a selected signal line to a non-selected signal line, the charge can be prevented from flowing out of the non-selected signal line via the time-division switch. Thus, the potential of the non-selected signal line can be maintained at the initially written signal potential. It is thus possible to eliminate the generation of insufficient contrast and non-uniformity of the luminance in the horizontal direction caused by the crosstalk of a signal potential from a selected signal line to a non-selected signal line, thereby maintaining a high image quality.

What is claimed is:

1. A liquid crystal display device comprising:

a first substrate having a display unit on which pixels are formed at intersections of gate lines for a plurality of rows and signal lines for a plurality of columns, said gate lines and said signal lines being arranged in a matrix;

a vertical drive circuit for driving said gate lines;

a horizontal drive circuit for outputting a time-series signal potential in correspondence with a predetermined number of time-divided portions;

a time-division switch for time-dividing the time-series signal potential output from said horizontal drive circuit and for supplying the divided time-series signal potential to a given signal line among said signal lines, said time-division switch having complementary transistors;

a select pulse generating circuit for generating a select pulse for activating said time-division switch, a low-level potential of the select pulse being set to be lower than a low-level potential of the signal potential output from said horizontal drive circuit;

a second substrate opposing said first substrate with a predetermined gap therebetween; and a liquid crystal layer encapsulated between said first substrate and said second substrate.

2. A liquid crystal display device according to claim 1, wherein said vertical drive circuit is disposed on said first substrate.

3. A liquid crystal display device according to claim 1, wherein said time-division switch is disposed on said first substrate.

4. A liquid crystal display device according to claim 1, wherein the low-level potential of the signal potential output from said horizontal drive circuit is a ground potential, and the low-level potential of the select pulse is lower than the ground potential.

5. A liquid crystal display device according to claim 1, wherein a high-level potential of the select pulse is higher than a high-level potential of the signal potential output from said horizontal drive circuit.

6. A liquid crystal display device according to claim 1, wherein the predetermined number of time-divided portions obtained by said time-division switch is three.

7. A liquid crystal display device according to claim 6, wherein said time-division switch comprises three analog switches corresponding to the number of time-divided portions.

8. A liquid crystal display device according to claim 1, wherein said horizontal drive circuit outputs the signal potential whose polarity is inverted in every horizontal scanning period to a common voltage which is supplied to all opposing electrodes of the pixels.

9. A liquid crystal display device according to claim 8, wherein an alternating current of the common voltage is inverted in every horizontal scanning period.

10. A liquid crystal display device comprising:

a plurality of pixels, each pixel of said plurality of pixels having a pixel gate electrode, a pixel source electrode, and a pixel drain electrode;

a vertical drive circuit, said vertical drive circuit supplying a plurality of scanning pulses, a scanning pulse of said plurality of scanning pulses each being supplied to a gate line of a plurality of gate lines, said gate line being connected to said pixel gate electrode;

a horizontal drive circuit, said horizontal drive circuit supplying a plurality of signal potentials, a signal potential of said plurality of signal potentials each having a signal potential high-level and a signal potential low-level;

a select pulse generating circuit, said select pulse generating circuit generating a plurality of signal pulses, a signal pulse of said plurality of signal pulses each having a signal pulse high-level and a signal pulse low-level, said signal pulse low-level being less than said signal potential low-level; and a time-division switch, said time-division switch having at least one analog switch, said analog switch having complementary transistors, said analog switch manipulating only one signal line of a plurality of signal lines.

11. A liquid crystal display device according to claim 10, wherein multiple signal pulses of said plurality of signal pulses control said analog switch.

12. A liquid crystal display device according to claim 11, wherein said complementary transistors comprise:

a first transistor, said first transistor having a first gate, a first input source/drain, and a first output source/drain; and a second transistor, said second transistor having a second gate, a second input source/drain connected to said first input source/drain, and a second output source/drain connected to said first output source/drain.

13. A liquid crystal display device according to claim 11, wherein:

one of said multiple signal pulses is supplied to said first gate;

another of said multiple signal pulses is supplied to said second gate;

said first input source/drain and said second input source/drain are connected to said signal potential; and said first output source/drain and said second output source/drain are connected to said signal line.

14. A liquid crystal display device according to claim 11, wherein said one of said multiple signal pulses is inverted from said another of said multiple signal pulses.

15. A liquid crystal display device according to claim 11, wherein said first transistor is a PMOS transistor and said second transistor is an NMOS transistor.

16. A liquid crystal display device according to claim 10, wherein said signal pulse high-level is higher than said signal potential high-level.

17. A liquid crystal display device according to claim 10, wherein said signal potential low-level is a ground potential.

18. A liquid crystal display device according to claim 10, wherein said signal line is connected to said pixel source electrode.

19. A liquid crystal display device according to claim 10, wherein said time-division switch supplies said signal potential to multiple analog switches.

20. A liquid crystal display device according to claim 10, wherein said plurality of signal potentials drives said liquid crystal display device.

21. A liquid crystal display device according to claim 10, wherein said horizontal drive circuit converts digital data into said each signal potential.

22. A liquid crystal display device according to claim 10, wherein a plurality of said pixel gate electrodes is connected to said gate line.

23. A liquid crystal display device according to claim 10, wherein a plurality of said pixel source electrodes is connected to said signal line.

24. A liquid crystal display device according to claim 10, wherein said horizontal drive circuit further comprises:

a horizontal drive shift register;

a horizontal drive level shifter;

a horizontal drive data latch;

a horizontal drive D/A converter; and a horizontal drive buffer.

25. A liquid crystal display device according to claim 10, wherein said vertical drive circuit further comprises:

a vertical drive shift register;

a vertical drive level shifter; and a vertical drive buffer.

* * * * *